US006421937B2

(12) United States Patent
Heller

(10) Patent No.: US 6,421,937 B2
(45) **Date of Patent: *Jul. 23, 2002**

(54) DETACHABLE CLEAT SYSTEM

(75) Inventor: Gunther Manfred Heller, Rodalben (DE)

(73) Assignee: adidas International B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 09/923,821

(22) Filed: Aug. 7, 2001

Related U.S. Application Data

(63) Continuation of application No. 09/391,543, filed on Sep. 8, 1999, now Pat. No. 6,301,806.

(30) Foreign Application Priority Data

Nov. 2, 1998 (DE) ..... 198 50 449

(51) Int. Cl.[7] ..... A43B 5/00
(52) U.S. Cl. ..... 36/134; 36/67 D; 36/127
(58) Field of Search ..... 36/134, 126–129, 36/67 D, 67 A, 67 R, 36 R, 61

(56) References Cited

U.S. PATENT DOCUMENTS

| | | | | |
|---|---|---|---|---|
| 1,989,475 A | | 1/1935 | Ehrmann | 36/36 R |
| 3,082,549 A | | 3/1963 | Dolceamore | 36/134 |
| 3,352,034 A | | 11/1967 | Braun | 36/67 |
| 3,816,945 A | | 6/1974 | Egtvedt | 36/2.5 AE |
| 4,357,763 A | | 11/1982 | Fleischmann et al. | 36/67 |
| 4,445,288 A | | 5/1984 | Frör | 36/134 |
| 4,445,289 A | | 5/1984 | Benéteau | 36/134 |
| 4,492,047 A | | 1/1985 | Arff | 36/134 |
| 4,648,187 A | | 3/1987 | Dassler et al. | 36/134 |
| 5,025,576 A | | 6/1991 | Biasiotto et al. | 36/134 |
| 5,243,775 A | | 9/1993 | Swain | 36/134 |
| 5,299,369 A | | 4/1994 | Goldman | 36/61 |
| 5,628,129 A | | 5/1997 | Kilgore et al. | 36/134 |
| 5,638,615 A | | 6/1997 | Korsen | 36/134 |
| 5,732,482 A | | 3/1998 | Remington et al. | 36/61 |
| 5,960,568 A | | 10/1999 | Bell et al. | 36/134 |
| 6,301,806 B1 | * | 10/2001 | Heller | 36/134 |

FOREIGN PATENT DOCUMENTS

| | | |
|---|---|---|
| EP | 163 823 | 11/1985 |
| EP | 171 228 | 2/1986 |
| EP | 248 664 | 12/1987 |
| EP | 261 557 | 3/1988 |

(List continued on next page.)

*Primary Examiner*—Mickey Yu
*Assistant Examiner*—Jila M. Mohandesi
(74) *Attorney, Agent, or Firm*—Testa, Hurwitz & Thibeault, LLP

(57) ABSTRACT

An article of footwear, in particular a sports shoe or walking boot, that has an outersole and at least one stud which is releasably connected thereto and interacts with the ground. According to the invention, the at least one stud comprises a stud-fastening mechanism, and the outersole has at least one locking recess. Furthermore, the stud-fastening mechanism can be moved into a position in which it engages behind the locking recess in order to produce the releasable connection between stud and sole. Preferably, the fastening mechanism comprises at least one locking arm which is arranged in an essentially pivotable or displaceable manner in a cavity in the interior of the stud.

16 Claims, 3 Drawing Sheets

FOREIGN PATENT DOCUMENTS

| | | |
|---|---|---|
| EP | 282 257 | 9/1988 |
| EP | 346 624 | 12/1989 |
| EP | 360 202 | 3/1990 |
| EP | 451 379 | 10/1991 |
| EP | 783 845 | 7/1997 |
| EP | 815 759 | 1/1998 |
| GB | 2.028.102 | 3/1980 |
| GB | 2.098.457 | 11/1982 |
| GB | 2.115.673 | 9/1983 |
| GB | 2.160.146 | 12/1985 |
| GB | 2.252.488 | 8/1992 |
| GB | 2.257.616 | 1/1993 |
| GB | 2.313.999 | 12/1997 |
| JP | 09108009 | 4/1997 |
| WO | 81/01499 | 6/1981 |
| WO | 86/06592 | 11/1986 |
| WO | 90/09117 | 8/1990 |
| WO | 91/04685 | 4/1991 |
| WO | 91/15131 | 10/1991 |
| WO | 92/18027 | 10/1992 |
| WO | 94/09659 | 5/1994 |
| WO | 95/10957 | 4/1995 |
| WO | 97/15206 | 5/1997 |

* cited by examiner

DETACHABLE CLEAT SYSTEM

CROSS-REFERENCE TO RELATED APPLICATION

This application is a continuation of U.S. patent application Ser. No. 09/391,543, which was filed on Sep. 8, 1999, now U.S. Pat. No. 6,301,806, the entire contents of which are hereby incorporated herein by reference. Additionally, this application incorporates by reference, and claims priority to and the benefit of, German patent application Ser. No. 19850449.7, which was filed on Nov. 2, 1998.

TECHNICAL FIELD

The present invention relates to an article of footwear, the outsole of which is provided with exchangeable studs. In particular, the present invention relates to a stud-fastening mechanism which is preferably used for elongate studs.

BACKGROUND INFORMATION

It is known to provide sports shoes or walking boots, and in particular soccer shoes, with studs in order to increase the grip of the shoe, in particular, on soft ground such as grass. The term "studs" is to be understood in the context of the present invention as meaning all possible elements which are arranged on outsoles of footwear in order to increase grip. The term "studs" is intended to include; for example, conventional studs for soccer shoes, spikes as are used for sprinting shoes, and studs for walking boots. Only conventional soccer shoes are described in the following description of the prior art and the invention, however, it is the intention to also encompass all possible types of studs within the above meaning.

The use of studs on soccer shoes has long been known. The studs used originally formed an integral part of a soccer shoe outsole, which is usually made from plastic. This, however, had the drawback that the studs quickly wore down, in particular, as a result of running on hard surfaces, such as asphalt, resulting in the need to replace the entire shoe when the wear reached a critical level.

Furthermore, it was not possible to use studs adaptable to changing ground conditions or to adapt the shape and length of the studs to meet the individual needs of a player. If the ground conditions changed, and therefore the studs were unsuitable, it was necessary to use a new pair of shoes with the appropriate studs. Shoes with studs designed for particular requirements were expensive custom-made articles.

For this reason, studded footwear provided with exchangeable studs has long been offered. It was easy to provide exchangeable studs in the case of studs of round cross-section or with rotational symmetry, which were conventionally used. The stud, now usually made of metal, was simply screwed on to the outsole by means of a screw thread. With this known technique, it was possible by using self tightening screws to ensure that the screw connection between sole and stud did not become detached.

For some time, however, the prior art has been moving away from the use of round or rotationally symmetrical studs, since in many instances these studs no longer are able to satisfy current requirements with regard to optimum grip when quickly changing direction or sprinting or both. Therefore, it is now preferred to use elongate studs that have been optimized for particular types of sports with respect to their shape and orientation on the outsole.

The use of elongate or asymmetric studs, however, can cause problems because their orientation in the fitted state, as explained above, is important to the performance of the article of footwear. For this reason, the conventional connection between outsole and stud by means of a screw mechanism is no longer suitable, since attaching and tightening the stud does not result in a final defined position of the stud. Therefore, it has been necessary to find alternative fastening mechanisms for elongate or asymmetric studs to allow such studs to be fitted in the desired orientation or position with respect to the sole of the footwear. To avoid the risk of injury and to provide the desired grip properties, it has been necessary for suitable fastening mechanisms to fasten studs so that they are secured against rotation.

A possible fastening mechanism for elongate or asymmetric studs of this nature is described in U.S. Pat. No. 5,628,129. According to this known approach, an outsole is provided that has a plurality of receiving openings for studs that include a base part and a grip part. The base part comprises a plurality of engagement projections that extend from the base part on the circumferential side. In order to connect the stud to the outsole, the engagement projections are introduced into the receiving openings in such a manner that the engagement projections are in alignment with engagement notches that are provided in the receiving openings of the outsole. The stud is then fixed to the outsole by rotating the stud through a defined angle.

A further possible solution to the problems discussed above is disclosed in European patent No. 0,815,759. The elongate, exchangeable soccer studs described in this document have a polygonal base which can be introduced into a recess of complementary design in an outsole. In this way, it is ensured that the elongate stud can be fastened in a rotationally secure manner in the desired orientation. As with the conventional approach, the connection between stud and outsole is achieved by means of a screw that extends through a continuous opening in the stud into a screw thread of corresponding design in the outsole. In this case, the screw head is situated inside a recess in the outer end of the stud.

The solutions that are known from the prior art have a large number of drawbacks. For example, a substantial rotary force exerted on the stud built in accordance with U.S. Pat. No. 5,628,129 may cause the stud to become unscrewed from the receiving opening, resulting in a considerable risk of injury.

For an exchangeable stud in accordance with European patent No. 0,815,759, problems arise as a result of the fact that the screw head is arranged inside a recess in the outer end of the stud. In particular, if the screw becomes loose unintentionally, the large number of sharp edges may create a considerable risk of injury, particularly if players come into contact with the studs. For this reason alone, such a design likely would not be licensed by the Federation International Football Association (FIFA).

Furthermore, practical problems arise; it is clear that when the shoe is used, for example, on grass, the stud becomes very dirty with the result that it requires considerable effort to exchange the stud. In addition, when running on hard surfaces the wear to the outer end of the stud quickly leads to the screw head or other fastening mechanism that is generally normal to the sole of the shoe and disposed on a wear surface of the stud becoming abraded, making it impossible, or at least difficult, to exchange the stud and rendering the fastening mechanism non-reusable. Furthermore, the outer surface of the stud is usually relatively small in order to allow it to penetrate optimally into the ground. Due to the size requirements of the stud, it is only possible to use a comparatively small screw, since the screw head should never project beyond the end face of the stud. If it is only possible to use small screws, then the stud fastening may be insufficient. Also, exchangeable studs that require multiple parts for attaching to a shoe may be difficult and time consuming to exchange. For example, loose parts, in particular, relatively small parts can be hard to handle and susceptible to becoming lost.

An objective of the present invention is, therefore, that of providing exchangeable, preferably elongate studs for footwear which meet FIFA requirements with regard to the risk of injury and the reliability of the connection and which can be produced inexpensively and exchanged without problems.

SUMMARY OF THE INVENTION

Generally, the invention solves the problem outlined above by means of a stud-fastening mechanism which engages behind a locking recess which is provided in or on an outersole and thus becomes wedged or latched in the locking recess.

In one aspect, the invention relates to an article of footwear that includes an outersole, at least one stud, and a stud-fastening mechanism. The outersole includes at least one locking recess. The stud or studs may include a bearing axis and are releasably secured to the outersole via the locking recess. The stud-fastening mechanism can be disposed within the stud and can be moved into a locked position where the stud-mechanism engages behind the locking recess to releasably secure the stud to the outersole. The stud-fastening mechanism can be actuated through a sidewall of the stud. The stud is fixed against rotation after it is moved into a fitted position.

In another aspect, the invention relates to a sole for an article of footwear. The sole includes at least one locking recess, at least one stud, and a stud-fastening mechanism. The stud or studs may include a bearing axis and are releasably secured to the sole via the locking recess(es). The stud-fastening mechanism may be disposed within the stud and may be actuated through a side wall of the stud into a locked position where the stud-mechanism engages behind the locking recess to releasably secure the stud to the sole.

In still another aspect, the invention relates to a stud for shoe soles with locking recesses. The stud includes a bearing axis and a stud-fastening mechanism disposed within the stud. The stud-fastening mechanism may be actuated through a side wall of the stud into a locked position where it engages behind a locking recess disposed on a sole to releasably secure the stud to the sole.

Additional embodiments according to any of the foregoing aspects of the invention may include the following features. The stud can include an interaction portion that interacts with the ground when the stud is in use. The stud can also include a fastening portion that can be introduced into the locking recess. The locking recess can be of a complimentary design to accommodate the fastening portion of the stud. The fastening portion can include a circumferential side and a locking shoulder disposed at least partially on the circumferential side. The locking shoulder can engage a mating, holding undercut disposed within the locking recess.

In addition, the stud can define a cavity that extends from the interaction portion and opens out towards the fastening portion. The cavity can house the stud-fastening mechanism which can be actuated through a side wall of the interaction portion. The stud-fastening mechanism can be actuated from a fitted position to a locked position. The stud can be in the shape of a rounded wedge in cross-section and can include a taper towards the end of the interaction portion. The taper towards the end of the interaction portion can be asymmetric.

Further embodiments of the invention may include the following features. The stud-fastening mechanism can include at least one locking arm. The locking arm can be pivoted or moved or both within the cavity. The locking arm can move generally parallel to the bearing axis of the stud from a release position to a locked position where the locking arm engages a mating, locking undercut disposed within the locking recess. The locking arm can define an opening with an internal screw thread. The stud-fastening mechanism can include at least one screw element for engaging the internal screw thread. The screw element can be actuated through the side wall of the interaction portion and can include a projecting shoulder that acts as a stop. The locking arm and engaged screw element can be secured in the cavity by a pin. The locking arm can include a hook-shaped end and can be mounted in the cavity such that the hook-shaped end is substantially aligned with the locking shoulder of the fastening portion. The hook-shaped end or the locking shoulder or both can taper towards the interaction portion. The holding undercut and the locking undercut can taper towards the open end of the locking recess. The locking recess can be formed by a holding frame incorporated into the outersole and can comprise hard plastic or metal or both.

These and other objects, along with advantages and features of the present invention herein disclosed, will become apparent through reference to the following description of embodiments of the invention, the accompanying drawings, and the claims.

BRIEF DESCRIPTION OF THE DRAWINGS

In the drawings, like reference characters generally refer to the same parts throughout the different figures. Also, the drawings are not to scale; emphasis instead generally being placed upon illustrating the principles of the invention. Further preferred embodiments of the present invention are discussed in the following with reference to the drawings which show the following.

DESCRIPTION

Embodiments of the present invention are described below. It is, however, expressly noted that the present invention is not limited to these embodiments, but rather the intention is that modifications that are apparent to the person skilled in the art are also included. In particular, the present invention is not intended to be limited to soccer shoes, but rather to be used for all types of footwear in which standard profiled soles are insufficient to ensure that the wearer does not slip, so projections that penetrate into the ground (studs, spikes, etc.) are used, and the projections are releasably connected to the shoe sole.

Figure 1B:
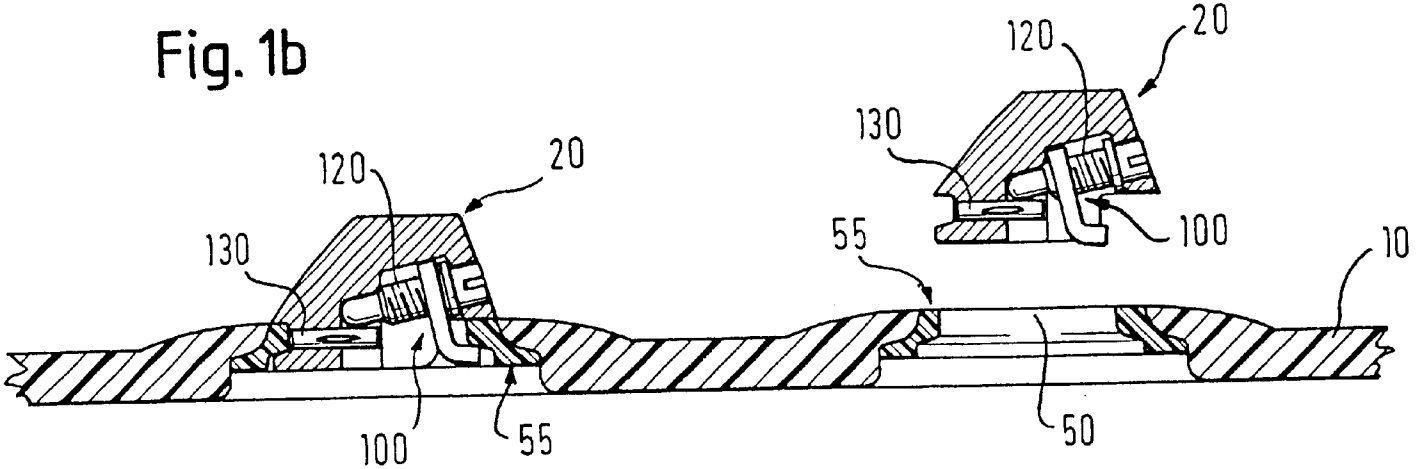
FIG. 1*b* is a lateral section on line Ib—Ib from FIG. 1*a*, with a fitted stud (on the left) and an unfitted stud (on the right).
Figure 1A:
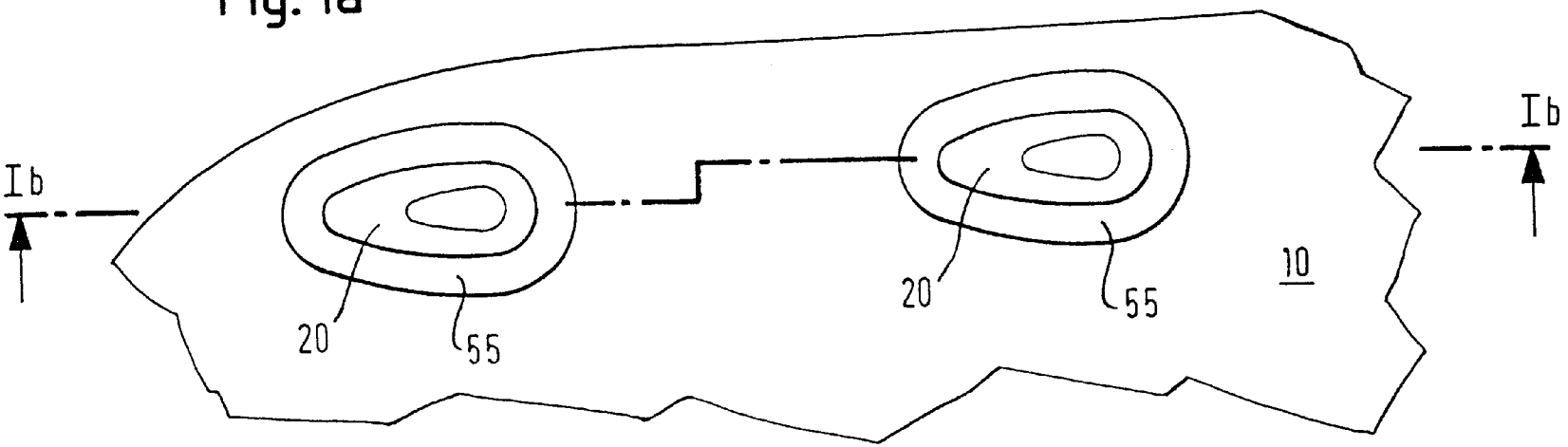
FIG. 1*a* is a view from below of an outersole of an article of footwear having studs according to the invention.

The present invention relates to exchangeable studs 20 as illustrated in FIG. 1. FIG. 1*a* shows part of a sole 10 of an article of footwear (not shown), as viewed from below. The studs 20 are preferably of an elongate design, include a rounded wedge shape in cross section and taper towards the side that interacts with the ground. As can be seen from FIG. 1*a*, the studs according to the invention taper asymmetrically towards their outer side. This allows the grip resistance to be adapted in a targeted manner depending on the type of sport. In the embodiment shown in FIG. 1*a*, for example, the studs have a grip which is increased towards the steeper side, i.e., the right-hand side, of the studs.

FIG. 1*b* shows a longitudinal section through the studs 20 on line Ib—Ib from FIG. 1*a*. In addition to the studs 20 having a stud-fastening mechanism 100, which is described in more detail below, it is also possible to see the holding frame 55 that defines the locking recess 50. FIG. 1*b* also shows a fitted stud 20 on the left and a stud 20 shortly before it is fitted on the right. The detailed structure of the stud 20 according to the invention and of the holding frame 55 according to the invention will be described below with reference to FIGS. 2 and 3.

Figure 2C:
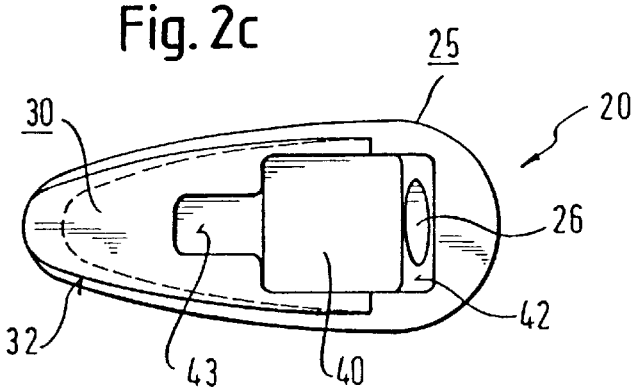
FIG. 2*c* is a view from below of the stud from FIG. 2*a* according to the invention.
Figure 2A:
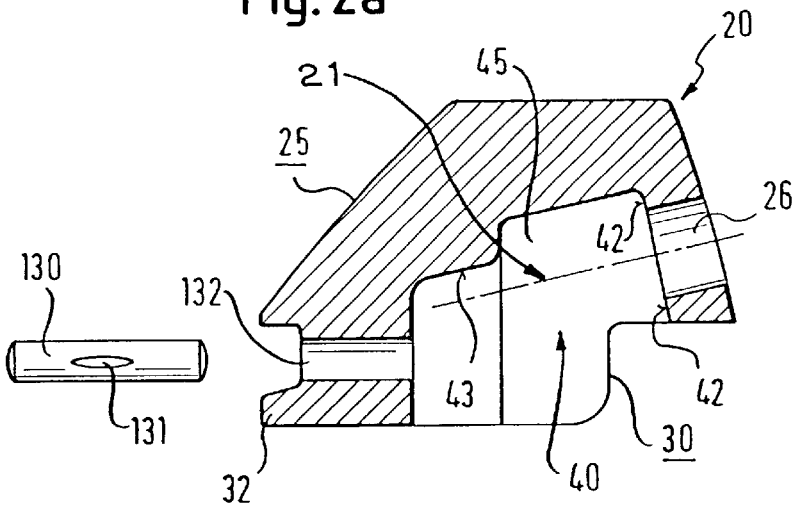
FIG. 2*a* is a section through a stud according to the invention on line Ib—Ib from FIG. 1*a*, without the stud-fastening mechanism and with the securing pin removed.

FIG. 2*a* shows a longitudinal section of the stud 20 along line Ib—Ib from FIG. 1*a*, but without the stud-fastening mechanism 100 and without the securing pin 130, which is to be described in more detail below. As can be seen from FIG. 2*a*, the stud 20 comprises two portions, namely an interaction portion 25 that interacts with the ground or surface and a fastening portion 30 that is used to fasten the stud 20 in the locking recess 50. In other words, when the studs are fitted it is only possible to see the interaction portion 25, while the fastening portion 30 is sunk into the locking recess 50.

As shown in FIG. 2*a*, the fastening portion 30 can have a locking shoulder 32 disposed at least partially around its lower edge, i.e., circumferential side, which can engage with a mating, holding undercut 52', disposed within the locking frame 55, in order to fasten the stud in the locking recess 50.

The stud 20 can have a cavity 40 into which the stud-fastening mechanism 100 can be disposed. The stud 20 includes a bearing axis 21 as represented by the centerline running through the stud cavity. In addition, the stud 20 has a through-bore 132, that extends substantially parallel to the underside of the stud in the region of the fastening portion 30. Furthermore, there is an additional through-bore 26 towards a narrow side wall of the fastening portion 30. The stud 20 can be made from a metal, such as magnesium or aluminum, or a plastic. Alternatively, it is also possible to coat a metal with plastic. It will be clear to the person skilled in the art that all possible stud materials of sufficient hardness are suitable.

Figure 2B:
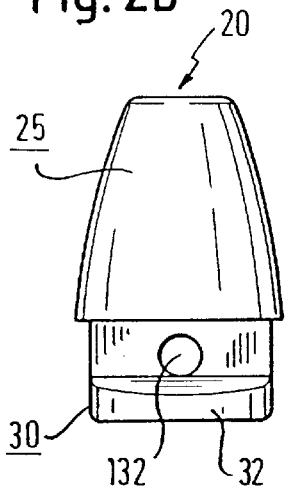
FIG. 2*b* is a rear view of a stud according to the invention.

FIGS. 2*b* and 2*c* show a side view and a view from below of the stud. These views provide a more detailed illustration of the stud's outer shape and the shape of the cavity 40.

Figure 2D:
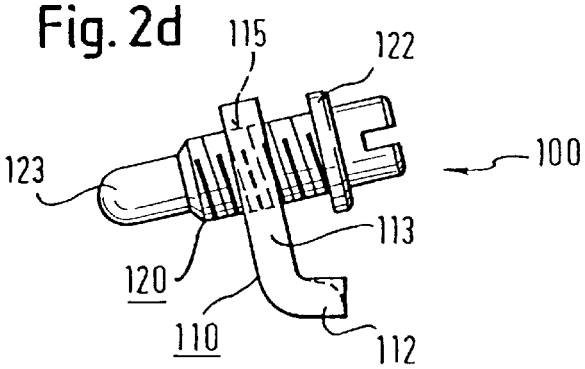
FIG. 2*d* is a detailed view of a stud-fastening mechanism according to the invention.

FIG. 2*d* provides a detailed illustration of the stud-fastening mechanism 100 according to the invention. It comprises two interacting parts; a locking arm 110 and a screw element 120. Both parts can be made of a metal, such as aluminum. Various other suitably strong materials, in particular other metals, can be used. The locking arm 110 comprises a hook end 112 and a support end 113. A through-bore 115 provided with an internal screw thread (not shown) is disposed within the support end 113. The screw element 120, the screw threads of which are diagrammatically depicted in FIG. 2*d*, extends through the internal screw thread. The screw element 120 can have a projecting shoulder 122 in the immediate vicinity of the screw head. The shoulder, after the stud-fastening mechanism 100 has been fitted, comes to bear against the inner wall of the cavity 40 in the region of the through-opening 26, where it serves as a stop.

The screw element 120 comprises a bearing part 123 that, with the stud-fastening mechanism 100 fitted, comes to bear against a surface 43 of complementary design inside the opening 40 in the stud 20. In the fitted state, the screw element 120 is thus mounted at two positions inside the cavity 40 with respect to the stud 20, namely, in the region of the bearing surface 43 and in the region of the bearing surface 42. Once fitted, the head of the screw element 120 may be relatively flush with the side wall of the stud. Furthermore, the cavity 40 in the stud 20 is shaped in such a way as to define a free space 45, through which the upper end of the support 113 can move parallel to the bearing axis 21 (see FIG. 2*a*) of the fastening mechanism 100 when the screw element 120 is screwed through the opening 26 from the outside.

In order to fit a stud in accordance with the invention, the stud-fastening mechanism 100 is preassembled as illustrated in FIG. 2*d* and is then introduced into the cavity 40 in the stud 20 from below until it has reached the position shown in FIG. 1*b*. Then, the securing pin 130 is driven into the stud through the opening 132 until it has reached the position shown in FIG. 1*b*. It is desirable, though not required, to provide a projection 131 on the securing pin 130 to prevent the securing pin 130 from moving out of the opening 132. In this way, the fastening mechanism 100 is prevented in a simple manner from falling out of the stud 20 in the unfitted state and also provides the mating surface for the bearing surface 43. Furthermore, the stud-fastening mechanism and the stud can be preassembled to form a single assembly for attaching to a shoe, thus, eliminating any loose parts.

FIG. 3 provides a detailed illustration of the holding frame 55 according to the invention in the unfitted state. The frame can be incorporated in the outersole 10 when the latter is produced. If the holding frame 55 is made of plastic, the attachment to the outersole is preferably produced by a chemical process. For this purpose, the holding frame 55 can be inserted into the injection mold that is used to produce the outersole 10. Nylon 11 or Nylon 12 is currently the preferred material for the outersole. Nylon 11 is currently the preferred material for the holding frame 55. Any other hard plastic, however, is also suitable. Alternatively, the holding frame 55 can also be made of a metal, for example, aluminum or steel. In the case of a holding frame 55 made from a metal, the frame is either clipped into a suitable recess in a sole that has already been produced, or else the holding frame 55, like a plastic holding frame, is inserted into a mold and the plastic is then injected around it. The latter variant is currently preferred for metal holding frames. In this case, however, the attachment to the plastic sole is mechanical, i.e., suitable holes or apertures into which the liquid plastic for the sole penetrates and hardens have to be provided in the holding frame 55.

Figure 3A:
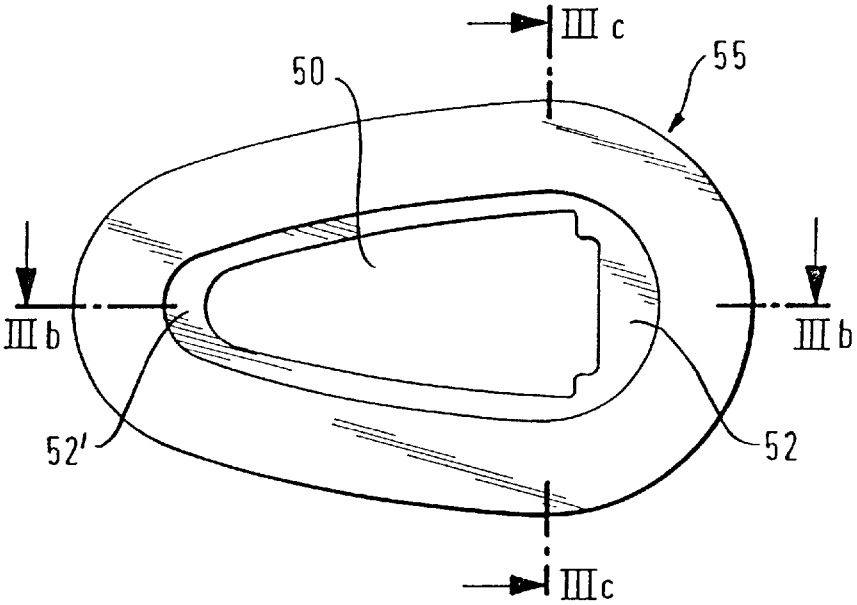
FIG. 3*a* is a view from below of a holding frame according to the invention.
Figure 3C:
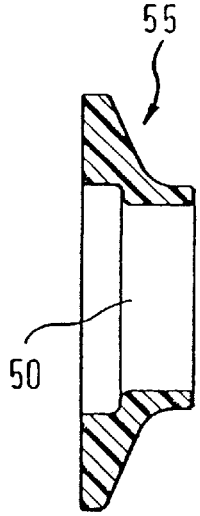
FIG. 3*c* is a lateral section on line IIIc—IIIc from FIG. 3*a* of the holding frame according to the invention.
Figure 3B:
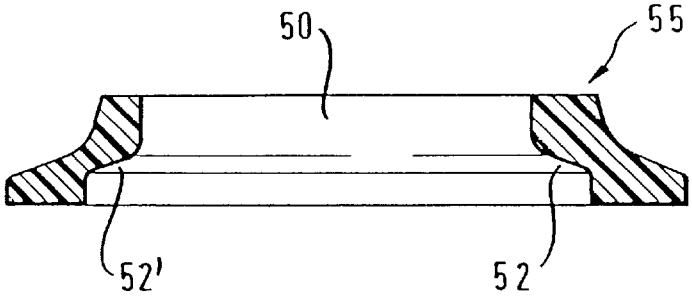
FIG. 3*b* is a longitudinal section online IIIb—IIIb from FIG. 3*a* of the holding frame according to the invention.

The longitudinal and transverse sections through the holding frame 55 that are illustrated in FIGS. 3*b* and 3*c* clearly show the locking recess 50 according to the invention with the undercuts 52 and 52', which ensure that the stud 20 according to the invention is held securely in the locking recess 50. The stud 20 is initially introduced into the locking

*recess* 50 in such a manner that the locking shoulder 32, which preferably extends at least part way around the circumference of the fastening portion, 30, comes to lie below the undercut 52', which is preferably of a complementary design, and engages behind the undercut 52'. A particular advantage is gained if either the undercut 52' or the locking shoulder 32 or both are designed so as to taper conically, as described in more detail below.

When this fitted position has been reached, the remaining part of the stud 20, the right-hand part of the stud 20, is pushed further into the locking recess 50 until the fastening portion 30 has been sunk completely into the locking recess 50. Preferably, the locking recess 50 is dimensioned in such a way that even in the fitted position the stud is prevented from falling out as a result, for example, of the sole 10 being turned. Then, the screw head of the screw element 120 is screwed through the through-opening 26 by means of a suitable tool (in this case a screwdriver). Due to the fixed mounting of the screw element 120, this leads to the locking arm 110 being displaced parallel to the bearing axis 21 of the fastening mechanism, which leads to the hook end 112 of the locking arm 110 engaging behind the locking recess 50 in the region of the undercut 52.

If the undercut 52 or the hook end 112 or both are designed so as to taper conically, tightening the screw element 120 leads to the fastening portion 30 of the stud 20 being pulled into the locking recess 50. Since the longitudinal dimensions of the stud 20 are increased by the lateral movement of the hook-shaped end 112, the locking recess 50 illustrated in FIG. 3*a* is elongated, leading to a further securing of the fastening portion 30 in the locking recess 50.

It is clear that the stud 20 in accordance with the invention that has been fitted in this way is very inexpensive to produce and can be fastened to the sole 10 in a manner that is secure against rotation, thus avoiding any risk of accidents.

In the above-described embodiment of the present invention, the stud-fastening mechanism 100 according to the invention comprises only a single displaceable locking arm and a fastening portion 30 which is formed integrally with the stud 20. It will be clear to the person skilled in the art, however, that as an alternative to the fastening portion 30 it is also possible to use an additional locking arm or a multiplicity of locking arms which are in each case actuated by means of screw mechanisms so as to engage into or behind a locking recess or locking recesses provided on the sole. Furthermore, it will be clear to the person skilled in the art that the locking recess does not necessarily have to be provided in the interior of the sole 10, but rather can also be provided in the interior of a separately provided base. In addition, it is possible to vary both the shape of the locking arm 110 and the actuation mechanism of the locking arm.

Having described embodiments of the invention, it will be apparent to those of ordinary skill in the art that other embodiments incorporating the concepts disclosed herein can be used without departing from the spirit and the scope of the invention. The described embodiments are to be considered in all respects only as illustrative and not restrictive. Therefore, it is intended that the scope of the present invention be only limited by the following claims.

What is claimed is:

1. An article of footwear, comprising:

an outersole defining a locking recess;

a stud defining a cavity; and a stub-fastening mechanism disposed within the stud cavity, the stud-fastening mechanism including a locking arm and a screw, wherein the locking arm is movable along a portion of the screw between a release position and a locked position.

2. The article of footwear of claim 1, wherein the stub further comprises:

an interaction portion that interacts with the ground; and a fastening portion that is introduced into the locking recess, the locking recess, the locking recess being of complimentary design to accommodate the fastening portion of the stud.

3. The article of footwear of claim 2, wherein the locking arm of the stub-fastening mechanism includes a hook-shaped end, the hook-shaped end can be pivoted or moved or both within the cavity, and the hook-shaped end can engage a mating, locking undercut disposed within the locking recess.

4. The article of footwear of claim 1, wherein the locking arm defines an opening with an internal screw thread adapted to receive the screw.

5. The article of footwear of claim 4, wherein the locking arm engaged with the screw can be secured in the cavity by a pin.

6. The article of footwear of claim 2, wherein the screw can be actuated through a side wall of the interaction portion.

7. The article of footwear of claim 1, wherein the screw includes a projecting shoulder that acts as a stop.

8. The article of footwear of claim 3, wherein the fastening portion includes a circumferential side and a locking shoulder, the locking shoulder being disposed at least partially on the circumferential side and engageable behind a mating, holding undercut disposed within the locking recess.

9. The article of footwear of claim 8, wherein the locking arm is mounted in the cavity such that the hook-shaped end is substantially aligned with the locking shoulder of the fastening portion.

10. The article of footwear of claim 9, wherein at least one of the locking shoulder of the fastening portion and the hook-shaped end of the locking arm taper towards the interaction portion.

11. The article of footwear of claim 8, wherein the holding undercut and the locking undercut taper towards the open end of the locking recess.

12. The article of footwear of claim 1, wherein the locking recess is defined by a holding frame incorporated in the outersole and comprises at least one of a hard plastic and a metal.

13. The article of footwear of claim 1, wherein the stud is in the shape of a rounded wedge in cross-section and includes a taper towards the end of the interaction portion.

14. The article of footwear of claim 13, wherein the taper towards the end of the interaction portion is asymmetric.

15. A sole, comprising:

a bottom surface defining a locking recess;

a stud defining a cavity; and a stud-fastening mechanism disposed within the cavity, the stud-fastening mechanism including a locking arm and a screw, wherein the locking arm is movable along a portion of the screw between a release position and a locked position.

16. A removable stud for a shoe sole, the stud comprising:

a stud body defining a cavity; and a stud-fastening mechanism disposed within the cavity, the stud-fastening mechanism including a locking arm and a screw, wherein the locking arm is movable along a portion of the screw between a release position and a locked position.

* * * * *

UNITED STATES PATENT AND TRADEMARK OFFICE

CERTIFICATE OF CORRECTION

PATENT NO. : 6,421,937 B2
DATED : July 23, 2002
INVENTOR(S) : Heller

It is certified that error appears in the above-identified patent and that said Letters Patent is hereby corrected as shown below:

Title page,
Item [56], References Cited, FOREIGN PATENT DOCUMENTS, please delete "2.115.673" and replace it with -- 2.115.683 --.

Column 8,
Line 3, please delete the word "stub-fastening" and replace it with the word -- stud-fastening --.
Line 8, please delete the word "stub" and replace it with the word -- stud --.
Line 12, please delete the first instance of the phrase "the locking recess,".
Line 16, please delete the word "stub-fastening" and replace it with the word -- stud-fastening --.

Signed and Sealed this

Twenty-ninth Day of October, 2002

*Attest:*

*Attesting Officer*

JAMES E. ROGAN
*Director of the United States Patent and Trademark Office*